US009222479B2

(12) United States Patent
Wei et al.

(10) Patent No.: US 9,222,479 B2
(45) Date of Patent: Dec. 29, 2015

(54) FAN AND FAN FRAME THEREOF

(75) Inventors: Yu-Te Wei, New Taipei (TW); Wei-Lung Chan, New Taipei (TW); Chang-Han Tsai, New Taipei (TW)

(73) Assignee: COOLER MASTER DEVELOPMENT CORPORATION, Zhonghe Dist., New Taipei (TW)

( * ) Notice: Subject to any disclaimer, the term of this patent is extended or adjusted under 35 U.S.C. 154(b) by 505 days.

(21) Appl. No.: 13/591,198

(22) Filed: Aug. 21, 2012

(65) Prior Publication Data

US 2014/0056693 A1 Feb. 27, 2014

(51) Int. Cl.

| | |
|---|---|
| ***F04D 19/00*** | (2006.01) |
| ***F04D 25/06*** | (2006.01) |
| ***F04D 29/60*** | (2006.01) |
| ***F04D 29/66*** | (2006.01) |

(52) U.S. Cl.

CPC ..... *F04D 25/0613* (2013.01); *F04D 29/601* (2013.01); *F04D 29/668* (2013.01)

(58) Field of Classification Search

CPC .... F04D 25/601; F04D 25/613; F04D 29/668
USPC ..... 415/119

See application file for complete search history.

(56) References Cited

U.S. PATENT DOCUMENTS

| | | | | |
|---|---|---|---|---|
| 5,186,605 | A * | 2/1993 | Tracy | 601/2 |
| 2008/0247864 | A1* | 10/2008 | Chang et al. | 415/119 |
| 2012/0063886 | A1* | 3/2012 | Tsai | 415/119 |

FOREIGN PATENT DOCUMENTS

| | | | | |
|---|---|---|---|---|
| TW | M259853 | | 3/2005 | |
| TW | M355308 U | | 4/2009 | |
| TW | M408924 | * | 1/2011 | H05K 7/20 |

* cited by examiner

*Primary Examiner* — Woody A Lee, Jr.
(74) *Attorney, Agent, or Firm* — Winston Hsu; Scott Margo

(57) ABSTRACT

A fan includes a fan frame and a fan wheel. The fan frame includes a frame body and at least two vibration-proof members. The frame body has at least two positioning ribs, wherein the at least two positioning ribs protrude from a side wall of the frame body and are distributed symmetrically. Each of the vibration-proof members has a positioning groove. The positioning rib of the frame body is capable of being embedded in the positioning groove of the vibration-proof member so as to position the vibration-proof member on the side wall of the frame body. The fan wheel is rotatably disposed in the fan frame.

10 Claims, 2 Drawing Sheets

FAN AND FAN FRAME THEREOF

BACKGROUND OF THE INVENTION

1. Field of the Invention

The invention relates to a fan and a fan frame thereof and, more particularly, to a fan frame with vibration-proof members and a fan equipped with the fan frame.

2. Description of the Prior Art

Heat dissipating device is a significant component for electronic products. When an electronic product is operating, the current in circuit will generate unnecessary heat due to impedance. If the heat is accumulated in the electronic components of the electronic product without dissipating immediately, the electronic components may get damage due to the accumulated heat. Therefore, the performance of heat dissipating device is a significant issue for the electronic product.

So far the heat dissipating device used in the electronic product usually consists of a heat pipe, a heat dissipating fin and a fan, wherein one end of the heat pipe contacts the electronic component, which generates heat during operation, the other end of the heat pipe is connected to the heat dissipating fin, and the fan blows air to the heat dissipating fin so as to dissipate heat. In general, a fan frame of the fan is formed in one piece and the fan frame is fixed on the heat dissipating fin or a casing directly by screws. When the fan is actuated, vibration generated by the fan during rotation in high speed will be conducted to the heat dissipating fin or the casing such that the heat dissipating fin or the casing will be resonated by the vibration. Accordingly, the screws, which fix the fan, will loose so that the stability of the fan will be reduced and undesired noise will be generated.

SUMMARY OF THE INVENTION

The invention provides a fan frame with vibration-proof members and a fan equipped with the fan frame, so as to solve the aforesaid problems.

According to an embodiment of the invention, a fan comprises a fan frame and a fan wheel. The fan frame comprises a frame body and at least two vibration-proof members. The frame body has at least two positioning ribs, wherein the at least two positioning ribs protrude from a side wall of the frame body and are distributed symmetrically. Each of the vibration-proof members has a positioning groove. The positioning rib of the frame body is capable of being embedded in the positioning groove of the vibration-proof member so as to position the vibration-proof member on the side wall of the frame body. The fan wheel is rotatably disposed in the fan frame.

In this embodiment, the fan frame may further comprise at least four fixing members. Two first fixing holes are formed on each of the vibration-proof members and two second fixing holes are formed on opposite sides of each of the positioning ribs. Each of the fixing members passes through one of the first fixing holes and one of the second fixing holes so as to fix the vibration-proof member on the side wall of the frame body. Furthermore, a third fixing hole is formed on each of the vibration-proof members.

According to another embodiment of the invention, a fan frame comprises a frame body and at least two vibration-proof members. The frame body has at least two positioning ribs, wherein the at least two positioning ribs protrude from a side wall of the frame body and are distributed symmetrically. Each of the vibration-proof members has a positioning groove. The positioning rib of the frame body is capable of being embedded in the positioning groove of the vibration-proof member so as to position the vibration-proof member on the side wall of the frame body.

In this embodiment, the fan frame may further comprise at least four fixing members. Two first fixing holes are formed on each of the vibration-proof members and two second fixing holes are formed on opposite sides of each of the positioning ribs. Each of the fixing members passes through one of the first fixing holes and one of the second fixing holes so as to fix the vibration-proof member on the side wall of the frame body. Furthermore, a third fixing hole is formed on each of the vibration-proof members.

As mentioned in the above, the invention disposes at least two vibration-proof members on the side wall of the frame body of the fan frame symmetrically and fixes the frame body of the fan frame on a heat dissipating fin or a casing through the third fixing hole formed on each of the vibration-proof members. Accordingly, when the fan is actuated, vibration generated by the fan during rotation in high speed will be absorbed by the vibration-proof members instead of being conducted to the heat dissipating fin or the casing such that the stability of the fan will be improved and undesired noise will not be generated.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
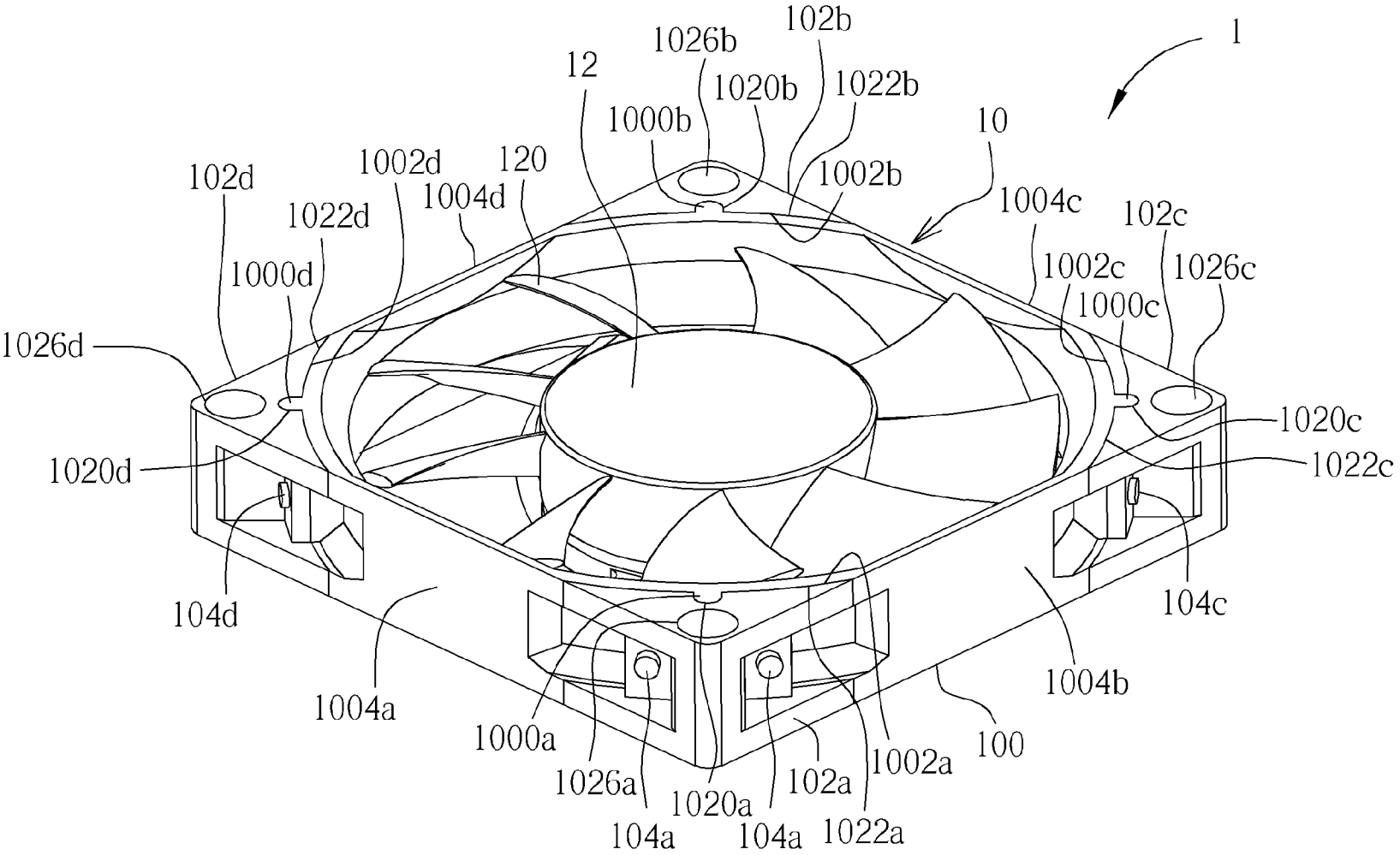
FIG. 1 is a perspective view illustrating a fan according to a first embodiment of the invention.
Figure 2:
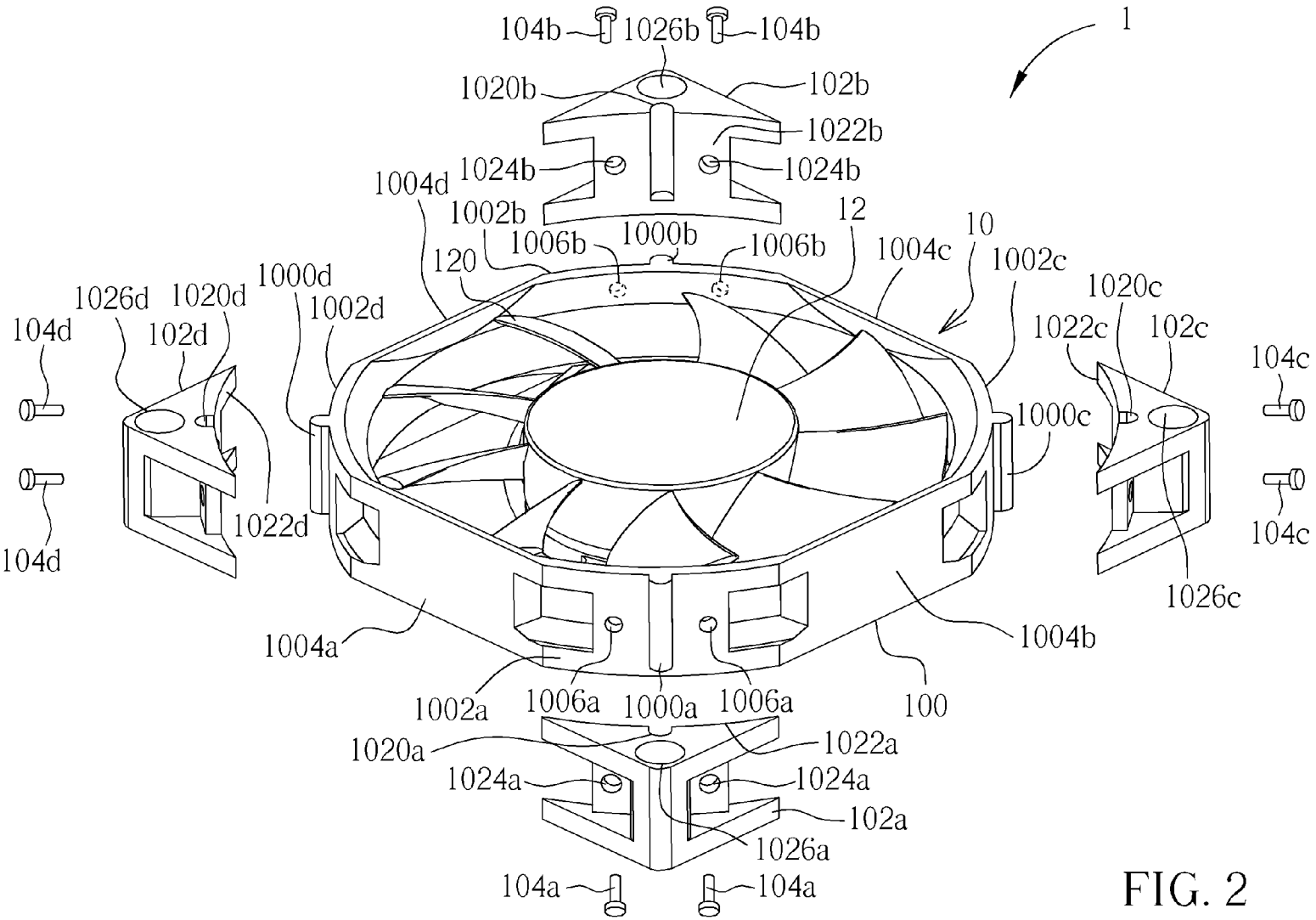
FIG. 2 is an exploded view illustrating the fan shown in FIG. 1.

Referring to FIGS. 1 and 2, FIG. 1 is a perspective view illustrating a fan 1 according to a first embodiment of the invention, and FIG. 2 is an exploded view illustrating the fan 1 shown in FIG. 1. As shown in FIGS. 1 and 2, the fan 1 comprises a fan frame 10 and a fan wheel 12. The fan wheel 12 is rotatably disposed in the fan frame 10 and comprises a plurality of blades 120.

In this embodiment, the fan frame 10 comprises a frame body 100, four vibration-proof members 102*a*-102*d* and eight fixing members 104*a*-104*d*. The frame body 100 has four positioning ribs 1000*a*-1000*d*, wherein the four positioning ribs 1000*a*-1000*d* protrude from a side wall of the frame body 100 and are distributed symmetrically, two positioning ribs 1000*a*, 1000*b* are opposite to each other, and the other two positioning ribs 1000*c*, 1000*d* are opposite to each other. In this embodiment, the side wall of the frame body 100 has four convex arc surfaces 1002*a*-1002*d* and four flat surfaces 1004-1004*d*, wherein the four positioning ribs 1000*a*-1000*d* protrude from the four convex arc surfaces 1002*a*-1002*d* respectively. As shown in FIG. 2, the four convex arc surfaces 1002*a*-1002*d* and the four flat surfaces 1004-1004*d* are connected to each other such that the frame body 100 is substantially circular-like.

Each of the vibration-proof members 102*a*-102*d* has a positioning groove 1020*a*-1020*d*. In this embodiment, each of the vibration-proof members 102*a*-102*d* has a concave arc surface 1022*a*-1022*d*, wherein the four positioning grooves 1020*a*-1020*d* are formed on the four concave arc surfaces 1022*a*-1022*d* respectively. Furthermore, two first fixing holes are formed on each of the vibration-proof members 102*a*-

102*d* and two second fixing holes are formed on opposite sides of each of the positioning ribs 1000*a*-1000*d*. It should be noted that, due to viewing angle, FIG. 2 only shows two first fixing holes 1024*a* on the vibration-proof member 102*a*, two first fixing holes 1024*b* on the vibration-proof member 102*b*, two second fixing holes 1006*a* on opposite sides of the positioning rib 1000*a* and two second fixing holes 1006*b* on opposite sides of the positioning rib 1000*b*. Moreover, a third fixing hole 1026*a*-1026*d* is formed on each of the vibration-proof members 102*a*-102*d*. Still further, each of the vibration-proof members 102*a*-102*d* has a top surface and a bottom surface opposite to the top surface. Each of the positioning grooves 1020*a*-1020*d* extends from one of the top surface and the bottom surface toward the other one of the top surface and the bottom surface. Each of the positioning grooves 1020*a*-1020*d* is exposed on at least one of the top surface and the bottom surface.

To assemble the frame body 100 and the vibration-proof member 102*a*, the positioning rib 1000*a* of the frame body 100 may be embedded in the positioning groove 1020*a* of the vibration-proof member 102*a* in a sliding manner since the positioning groove 1020*a* is exposed on at least one of the top surface and the bottom surface of the vibration-proof member 102*a*, so as to position the vibration-proof member 102*a* on the side wall of the frame body 100. When the positioning rib 1000*a* is embedded in the positioning groove 1020*a*, the convex arc surface 1002*a* of the frame body 100 fits the concave arc surface 1022*a* of the vibration-proof member 102*a* exactly. Afterward, the fixing member 104*a* can pass through the first fixing hole 1024*a* of the vibration-proof member 102*a* and the second fixing hole 1006*a* of the frame body 100 so as to fix the vibration-proof member 102*a* on the side wall of the frame body 100. In practical applications, the fixing member 104*a* may be a screw and a nut, which can be fixed with the screw, may be installed in the second fixing hole 1006*a*. It should be noted that the other three vibration-proof members 102*b*-102*d* can be assembled to the frame body 100 in the same manner as the vibration-proof member 102*a* and the operation thereof will not be depicted herein. The frame body 100 and the vibration-proof members 102*a*-102*d* can be assembled more effectively through the cooperation of the positioning ribs 1000*a*-1000*d* and the positioning grooves 1020*a*-1020*d*.

As shown in FIG. 1, after assembling the fan frame 10, the four convex arc surfaces 1002*a*-1002*d* of the frame body 100 fit the four concave arc surfaces 1022*a*-1022*d* of the four vibration-proof members 102*a*-102*d* exactly so that the fan frame 10 is rectangular. Then, screws or other fixing members (not shown) can pass through the four third fixing holes 1026*a*-1026*d* of the four vibration-proof members 102*a*-102*d* so as to fix the fan frame 10 on a heat dissipating fin or a casing (not shown).

In this embodiment, the four vibration-proof members 102*a*-102*d* may be made of rubber, plastic or other materials capable of absorbing vibration. Accordingly, when the fan wheel 12 rotates, vibration generated by the fan 1 during rotation in high speed will be absorbed by the four vibration-proof members 102*a*-102*d* instead of being conducted to the heat dissipating fin or the casing (not shown) such that the stability of the fan 1 will be improved and undesired noise will not be generated.

It should be noted that the invention may dispose only two vibration-proof members 102*a*, 102*b* on opposite sides of the frame body 100 symmetrically or dispose only two vibration-proof members 102*c*, 102*d* on the other opposite sides of the frame body 100 symmetrically to improve the stability of the fan 1 during rotation in high speed and avoid generating undesired noise. In other words, the invention is not limited to dispose four vibration-proof members 102*a*-102*d* on the side wall of the frame body 100 at the same time.

As mentioned in the above, the invention disposes at least two vibration-proof members on the side wall of the frame body of the fan frame symmetrically and fixes the frame body of the fan frame on a heat dissipating fin or a casing through the third fixing hole formed on each of the vibration-proof members. Accordingly, when the fan is actuated, vibration generated by the fan during rotation in high speed will be absorbed by the vibration-proof members instead of being conducted to the heat dissipating fin or the casing such that the stability of the fan will be improved and undesired noise will not be generated.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fan comprising:

a fan frame comprising:

a frame body having at least two positioning ribs, the at least two positioning ribs protruding from a side wall of the frame body and being distributed symmetrically; and at least two vibration-proof members, each of the vibration-proof members having a top surface, a bottom surface opposite to the top surface, and a positioning groove, the positioning groove extending from one of the top surface and the bottom surface toward the other one of the top surface and the bottom surface, the positioning groove being exposed on at least one of the top surface and the bottom surface, the positioning rib of the frame body being capable of being embedded in the positioning groove in a sliding manner, so as to position the vibration-proof member on the side wall of the frame body; and a fan wheel rotatably disposed in the fan frame.

2. The fan of claim 1, wherein the fan frame further comprises at least four fixing members, two first fixing holes are formed on each of the vibration-proof members, two second fixing holes are formed on opposite sides of each of the positioning ribs, each of the fixing members passes through one of the first fixing holes and one of the second fixing holes so as to fix the vibration-proof member on the side wall of the frame body.

3. The fan of claim 1, wherein the vibration-proof member is made of rubber or plastic.

4. The fan of claim 1, wherein a third fixing hole is formed on each of the vibration-proof members.

5. The fan of claim 1, wherein the side wall of the frame body has at least two convex arc surfaces, the at least two positioning ribs protrude from the at least two convex arc surfaces respectively, each of the vibration-proof members has a concave arc surface, the positioning groove is formed on the concave arc surface, and the convex arc surface fits the concave arc surface when the positioning rib is embedded in the positioning groove.

6. A fan frame comprising:

a frame body having at least two positioning ribs, the at least two positioning ribs protruding from a side wall of the frame body and being distributed symmetrically; and at least two vibration-proof members, each of the vibration-proof members having a top surface, a bottom surface opposite to the top surface, and a positioning groove, the positioning groove extending from one of the top surface and the bottom surface toward the other one of the top surface and the bottom surface, the positioning groove being exposed on at least one of the top surface and the bottom surface, the positioning rib of the frame body being capable of being embedded in the positioning groove in a sliding manner, so as to position the vibration-proof member on the side wall of the frame body.

7. The fan frame of claim 6, further comprising at least four fixing members, two first fixing holes being formed on each of the vibration-proof members, two second fixing holes being formed on opposite sides of each of the positioning ribs, each of the fixing members passing through one of the first fixing holes and one of the second fixing holes so as to fix the vibration-proof member on the side wall of the frame body.

8. The fan frame of claim 6, wherein the vibration-proof member is made of rubber or plastic.

9. The fan frame of claim 6, wherein a third fixing hole is formed on each of the vibration-proof members.

10. The fan frame of claim 6, wherein the side wall of the frame body has at least two convex arc surfaces, the at least two positioning ribs protrude from the at least two convex arc surfaces respectively, each of the vibration-proof members has a concave arc surface, the positioning groove is formed on the concave arc surface, and the convex arc surface fits the concave arc surface when the positioning rib is embedded in the positioning groove.

* * * * *